United States Patent [19]

Flaig et al.

[11] Patent Number: 4,475,513

[45] Date of Patent: Oct. 9, 1984

[54] FUEL METERING DEVICE FOR FUEL INJECTION PUMPS

[75] Inventors: Ulrich Flaig, Markgröningen; Johannes Locher, Stuttgart, both of Fed. Rep. of Germany

[73] Assignee: Robert Bosch GmbH, Stuttgart, Fed. Rep. of Germany

[21] Appl. No.: 417,737

[22] Filed: Sep. 13, 1982

[30] Foreign Application Priority Data

Oct. 15, 1981 [DE] Fed. Rep. of Germany ..... 3140933

[51] Int. Cl.[3] ..... F02M 51/00

[52] U.S. Cl. ..... 123/446; 123/460; 137/614.21; 137/614.2

[58] Field of Search ..... 123/446, 458, 460, 506; 137/614.21, 614.2, 614.19

[56] References Cited

U.S. PATENT DOCUMENTS

| | | | |
|---|---|---|---|
| 2,050,430 | 8/1936 | Grickson | 137/614.19 |
| 2,969,088 | 1/1961 | Kramer | 137/614.21 |
| 3,183,932 | 5/1965 | Karpus, Jr. | 137/614.21 |
| 3,538,951 | 11/1970 | Bownass | 137/614.21 |
| 3,724,436 | 4/1973 | Nagata et al. | 123/478 |
| 4,030,517 | 6/1977 | Pyle | 137/614.21 |

FOREIGN PATENT DOCUMENTS

| | | | |
|---|---|---|---|
| 1195 | 3/1979 | European Pat. Off. | 137/614.2 |
| 2137832 | 2/1972 | Fed. Rep. of Germany | 123/446 |

*Primary Examiner*—Magdalen Y. C. Moy

*Attorney, Agent, or Firm*—Edwin E. Greigg

[57] ABSTRACT

A fuel metering device for a fuel injection pump is proposed in which the amount of fuel to be injected is metered by means of a magnetic valve. An electro-magnetic valve and a back pressure valve are placed in series in the fuel supply channel leading to the pump work chamber of the fuel injection pump, whereby the back pressure valve places the closing element of the magnetic valve in the open position during the supply stroke of the fuel injection pump, so that only a small holding current is required to keep the magnetic valve open. Rapid switching of the magnetic valve is achieved by a mechanical closing by means of a closing spring of the magnetic valve after the exciter current is switched off.

4 Claims, 1 Drawing Figure

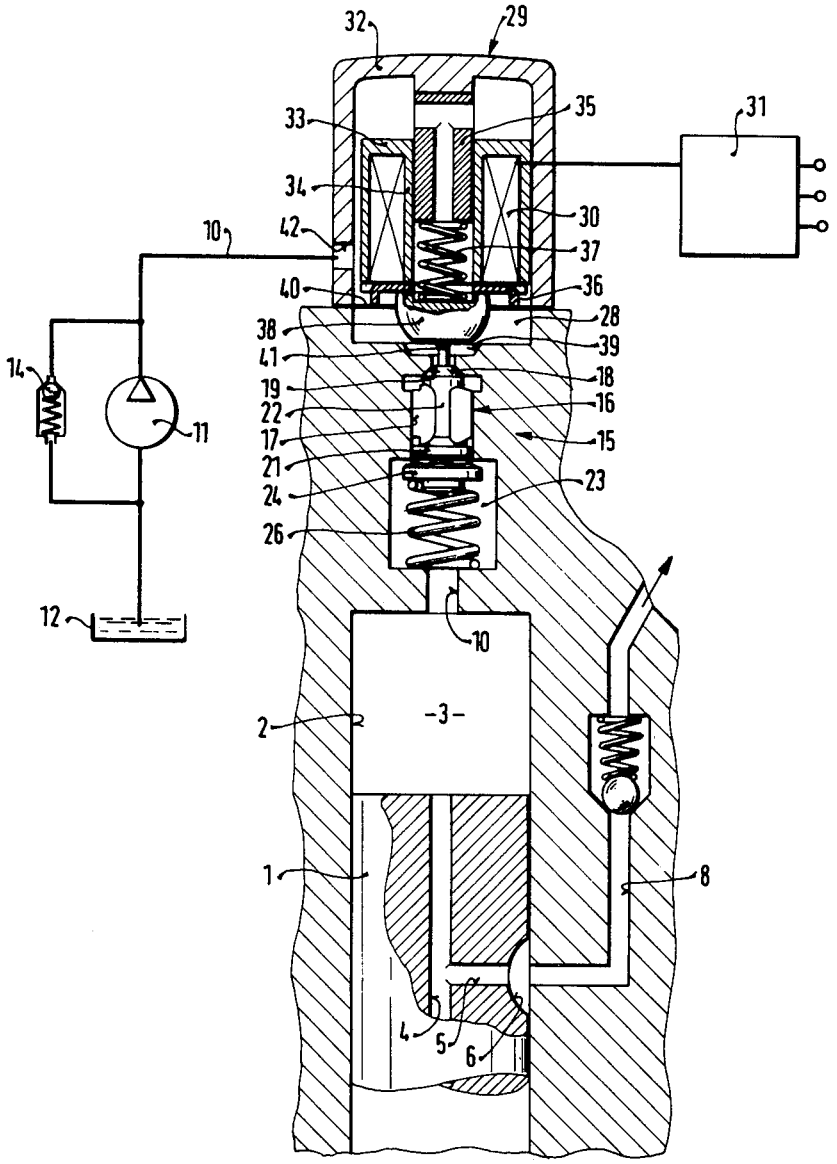
32
29
33
35
31
34
30
10
42
37
40
36
38
28
39
41
18
19
16
22
15
17
21
23
24
26
14
11
12
10
2
-3-
1
8
4
5
6

FUEL METERING DEVICE FOR FUEL INJECTION PUMPS

BACKGROUND OF THE INVENTION

The invention is based on a fuel metering device for fuel injection pumps provided with a magnetic valve and a fuel supply leading through a valve closing element to a pump work chamber of the fuel injection pump with the valve closing element being stressed by a spring in the direction of closing. In such a fuel metering device, known from U.S. Pat. No. 3,724,436, the valve closing element of the magnetic valve is controlled by the movements of the armature of the electromagnet. Therein, the closing element is moved to the open position by the excitation of the magnet winding against the force of the closing spring and, when the circuit of the electromagnet is interrupted, it is brought into the closed position again by the force of the closing spring. Such an embodiment of a magnetic valve for the metering of the fuel has the disadvantage of requiring considerable magnetic force not only to move the closing element against the closing force of the closing spring, but also to generate a sufficiently quick movement of the closing element. Furthermore, the distances traveled by the closing element are comparatively great. These characteristics negatively influence the switching speed of such a magnetic valve, which is required to switch very rapidly, especially for distributor injection pumps for high-speed and four-cylinder internal combustion engines. Such a valve also needs more electricity.

OBJECT AND SUMMARY OF THE INVENTION

The fuel metering device according to the present invention, has the advantage that the magnetic valve needs only to be subjected to a holding current which is turned off at the end of the fuel metering cycle. The closing of the magnetic valve is accomplished by the closing spring, while the actual opening is done by the back pressure valve, assisted by the pump supply pressure, against the force of the closing spring.

By the steps shown herein, advantageous developments and improvements of the solution shown are pointed out.

The invention will be better understood and further objects and advantages thereof will become more apparent from the ensuing detailed description of a preferred embodiment taken in conjunction with the drawing.

BRIEF DESCRIPTION OF THE DRAWING

An exemplary embodiment of the present invention is shown in the drawing and is described in greater detail in the following description.

DESCRIPTION OF THE EXEMPLARY EMBODIMENT

The FIGURE shows part of a distributor injection pump of a known kind. A pump piston 1 encloses a pump work chamber 3 in a cylinder 2. The pump work chamber can be connected, by way of an axial bore 4 and a radial bore 5, which branches off to a distributor groove 6 disposed on the surface of the pump piston, with one of the supply lines 8 when the pump piston is in the proper position. The supply lines are disposed in an axial plane around the periphery of the cylinder 2, depending on the number of injection points of the associated internal combustion engine. During the supply stroke of the pump piston one of the supply lines is connected with the distributor groove 6 at any given time.

The fuel supply of the pump work chamber 3 is effected by way of a fuel supply channel 10 branching off from the pressure side of a fuel supply pump 11. The fuel supply pump aspirates fuel in a known manner from a fuel tank 12, and the fuel pressure which can be created by the pump in the fuel supply channel 10 is regulated with the aid of a pressure control valve 14 placed in parallel with the pump.

The open cross-sectional area of the fuel supply channel 10 is regulated with the aid of a back pressure valve 15. The latter has a cylindrical closing element 16 axially disposed slidingly in a bore 17 of the fuel supply channel 10 and having a closing element 18, formed in cone-shape, on the surface which extends away from the pump work chamber 3. The closing element 18 cooperates with a respective valve seat 19 on the wall of the fuel supply channel 10. Furthermore, the closing element 16 has a piston part 21 closely fitted to the fuel supply channel bore 17. The closing element 16 has guide fins 22 between the piston part 21 and the closing element 18. The face of the closing element 16 which extends toward the pump work chamber is provided with the piston part 21 and therebeneath is affixed a collar 24. The collar is disposed in chamber 23, the diameter of which is larger than the diameter of the fuel supply channel bore 17, and the collar, the latter being supported on a pressure spring 26. The latter axially stresses the closing element 16 and is supported on the pump housing as shown.

Adjacent to the valve seat 19 the fuel supply channel 10 opens into a chamber 28, which is closed on its front by a magnetic valve 29 disposed coaxially to the back pressure valve 15. The magnetic valve consists of a magnet winding 30 disposed in a cup-shaped housing 32 tightly screwed into the housing of the fuel injection pump. The magnet winding 30 is seated in a cup-shaped magnetic flux conductor 33, the front of which forms the poles of the electro-magnet. The core 34 of the electro-magnet is disposed in the form of a tube into which a support pin 35 is extended from the one face. The armature of the electro-magnet is disposed as a flat armature 36 and between it and the support pin 35 is clamped a pressure spring 37 which is disposed within the core 34'. Coaxially to the axis of the electro-magnet a ball-shaped closing member 38 is fastened to the flat armature 36 and works together with a corresponding valve seat 39 which surrounds the entrance of the fuel supply channel 10 into the chamber 28. The closing member 38 is suspended from the flat armature 36 and passes through the guide membrane 40. When the flat armature is not attracted by the electro-magnet and the valve 38 is in its closed position, the flat armature is supported by the guide membrane 40. A pin 41 is provided coaxially to the fuel supply channel 10, and this pin can be fastened either on the closing member 16 of the back pressure valve 15 or on the closing member 38.

The electro-magnet or the magnet winding 30 is controlled by a control element 31. The inside of the housing 32 of the electro-magnet is connected to the chamber 28 and has an inlet orifice of the fuel supply channel 10.

As long as the pump piston 1 performs its supply stroke, a fuel pressure is generated in the pump work chamber 3, so that the back pressure valve 15 closes. The pin 41 now presses against valve 38 which forces the flat armature 36, opposite to the force of the pressure spring 37, against the poles of the magnetic flux conductor 33 and thereby lifts the valve closing member 38 from its seat 39. The chamber 28 is now filled with the fuel supplied by the fuel supply channel 10 because the fuel under pressure can pass between the valve 38 and the opening in the guide membrane 40 through which the valve 38 passes. Towards the end of the supply stroke, the magnet winding 30 is supplied with current by the control element 31, which current is just strong enough to maintain the flat armature in an attracted state. At the end of the supply stroke or the beginning of the suction stroke of the pump piston the back pressure valve 15 is opened so that the pin 41 separates from the closing member 38 and a connection between the chamber 28 and the pump work chamber 3 is made at the moment when the piston part 21 of the valve closing element 16 descends into the chamber 23. The valve closing element 38 remains in the open position under the influence of the magnetic force, so that fuel can now flow into the pump work chamber.

The supply of fuel is interrupted at the point when the current supply of winding 30 is interrupted. The armature 36 falls away under the influence of the pressure spring 37 and the valve closing element 38 closes the connection to the chamber 28. Since the pre-stressing of the pressure spring 37 is greater than the stressing of the back pressure valve by the pressure spring 26, the latter spring does not impede the closing movement.

The device described above has the advantage that with such a construction very rapid switching motions can be made, since the closing operation not only is performed mechanically and is little dependent on the speed of the dissolution of the magnetic field, but also the magnetic flux holding the armature 36 is very small and can be dissolved very rapidly. Altogether, very small magnets can be used and high switching speeds attained. Advantageously the magnet through which the fuel flows is also cooled by it.

The embodiment described here with the example of a distributor injection pump may be used, of course, just as well with fuel injection pumps of other kinds, such as radial piston pumps or series-type pumps.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel metering device for fuel injection pumps including a housing comprising a pump piston bore, a pump piston in said bore, a pump work chamber in said pump piston bore confined by said pump piston, said housing including a fuel supply passage extending from said pump work chamber to a fuel chamber, said fuel supply passage including oppositely disposed first and second valve seats, a magnetic valve secured to said housing in axial alignment with said fuel supply passage, said magnetic valve including a coil, a core and a valve closing member that is connected to a flat armature and which extends into said fuel chamber and seats on said second valve seat, said valve closing member being stressed by a closing spring in the direction of closing, a back pressure valve disposed in said fuel supply passage, said back pressure valve including a valve closing element arranged to close in the direction of the magnetic valve and seat against said first valve seat in said fuel supply line between said fuel chamber and said pump work chamber, a coupling means axially disposed between said valve closing element of said back pressure valve and said closing member of said magnetic valve and further wherein said coupling means functions to force said closing member of said magnetic valve to an open position where said valve closing element and said flat armature is adjacent said core when said valve closing element of said back pressure valve is in a closed position during a pressure stroke of said pump piston, and subsequent to said pressure stroke said valve closing element opens due to fuel pressure in said fuel chamber supplied by a fuel supply means, during a suction stroke of said pump piston, said magnetic valve is activated to hold said closing member of said magnetic valve open to permit fuel flow from said fuel chamber to said pump work chamber, and upon deactivation of said magnetic valve said valve closing member of said magnetic valve closes to prevent fuel flow to said pump work chamber.

2. A fuel metering device for fuel injection pumps including a housing comprising a pump piston bore, a pump piston in said bore, a pump work chamber in said pump piston bore confined by said pump piston, said housing including a fuel supply passage extending from said pump work chamber to a fuel chamber, said fuel supply passage including oppositely disposed first and second valve seats, a magnetic valve secured to said housing in axial alignment with said fuel supply passage, said magnetic valve including a valve closing member that extends into said fuel chamber and seats on said second valve seat, said valve closing member being stressed by a closing spring in the direction of closing, a back pressure valve disposed in said fuel supply passage, said back pressure valve including a valve closing element on one end thereof, a guide portion formed by spaced guide fins and a cylindrical guide portion extending from said valve closure element, and a larger diameter collar on its end opposite from said valve closure element, and a closing spring acting against said collar for forcing said back pressure valve to close in the direction of the magnetic valve and seat against said first valve seat in said fuel supply line between said fuel chamber and said pump work chamber, a coupling means axially disposed between said valve closing element of said back pressure valve and said closing member of said magnetic valve and further wherein said coupling means functions to force said closing member of said magnetic valve to an open position when said valve closing element of said back pressure valve is in a closed position during a pressure stroke of said pump piston, and subsequent to said pressure stroke said valve closing element opens due to fuel pressure in said fuel chamber supplied by a fuel supply means, during a suction stroke of said pump piston, said magnetic valve is activated to hold said closing member of said magnetic valve open to permit fuel flow from said fuel chamber to said pump work chamber, and upon deactivation of said magnetic valve said valve closing member of said magnetic valve closes to prevent fuel flow to said pump work chamber.

3. A fuel metering device for fuel injection pumps including a housing comprising a pump piston bore, a pump piston in said bore, a pump work chamber in said pump piston bore confined by said pump piston, said housing including a fuel supply passage extending from said pump work chamber to a fuel chamber, said fuel supply passage including oppositely disposed first and second valve seats, a magnetic valve secured to said housing in axial alignment with said fuel supply passage, said magnetic valve including a valve closing member that extends into said fuel chamber and seats on said second valve seat, said valve closing member being stressed by a closing spring in the direction of closing, a back pressure valve disposed in said fuel supply passage, said back pressure valve including a valve closing element arranged to close in the direction of the magnetic valve and seat against said first valve seat in said fuel supply line between said fuel chamber and said pump work said back pressure valve being stressed in the direction of closing by a closing spring, said closing spring of said closing member having a stronger spring force than said closing spring of said back pressure valve, a coupling means axially disposed between said valve closing element of said back pressure valve and said closing member of said magnetic valve and further wherein said coupling means functions to force said closing member of said magnetic valve to an open position when said valve closing element of said back pressure valve is in a closed position during a pressure stroke of said pump piston, and subsequent to said pressure stroke said valve closing element opens due to fuel pressure in said fuel chamber supplied by a fuel supply means, during a suction stroke of said pump piston, said magnetic valve is activated to hold said closing member of said magnetic valve open to permit fuel flow from said fuel chamber to said pump work chamber, and upon deactivation of said magnetic valve said valve closing member of said magnetic valve closes to prevent fuel flow to said pump work chamber.

4. A fuel metering device according to claim 2 wherein said closing spring of said magnetic valve has a stronger spring force than said closing spring of said back pressure valve.

* * * * *